US009752393B2

(12) United States Patent
Linklater et al.

(10) Patent No.: US 9,752,393 B2
(45) Date of Patent: Sep. 5, 2017

(54) TOOL ASSEMBLY APPARATUS AND METHOD

(71) Applicant: M-I Drilling Fluids U.K. Ltd., Aberdeen (GB)

(72) Inventors: James Linklater, Buckie (GB); James Edward Atkins, Aberdeen (GB); Seweryn Wrozyna, Aberdeen (GB)

(73) Assignee: M-I Drilling Fluids UK Ltd., Aberdeen (GB)

( * ) Notice: Subject to any disclaimer, the term of this patent is extended or adjusted under 35 U.S.C. 154(b) by 193 days.

(21) Appl. No.: 14/398,389

(22) PCT Filed: Apr. 10, 2013

(86) PCT No.: PCT/US2013/035911
§ 371 (c)(1),
(2) Date: Oct. 31, 2014

(87) PCT Pub. No.: WO2013/165661
PCT Pub. Date: Nov. 7, 2013

(65) Prior Publication Data

US 2015/0083396 A1 Mar. 26, 2015

(30) Foreign Application Priority Data

May 3, 2012 (GB) ..... 1207776.4

(51) Int. Cl.
*E21B 17/10* (2006.01)

(52) U.S. Cl.
CPC ..... *E21B 17/1085* (2013.01); *E21B 17/1078* (2013.01); *Y10T 29/49826* (2015.01); *Y10T 29/49947* (2015.01)

(58) Field of Classification Search
CPC ..... E21B 17/22; E21B 17/10; E21B 17/1085; E21B 17/04; E21B 17/046
(Continued)

(56) References Cited

U.S. PATENT DOCUMENTS 817,672 A * 4/1906 Sansom ..... F16D 1/094 403/247
1,671,458 A * 5/1928 Wilson ..... E21B 17/046 15/104.31

(Continued)

FOREIGN PATENT DOCUMENTS

GB 2417269 B 12/2006
WO 2011022580 A2 2/2011

OTHER PUBLICATIONS

International Search Report and Written Opinion of PCT Application Serial No. PCT/US2013/035911 dated Jul. 10, 2013 (14 pages).

*Primary Examiner* — Kenneth L Thompson
(74) *Attorney, Agent, or Firm* — David J. Smith

(57) ABSTRACT

An apparatus, comprising a body extending in an axial direction, a sleeve for the body, and locking means for locking the body and the sleeve. The body and the sleeve comprise complementary mating protrusions and recesses configured to positively interlock the body and the sleeve in the axial direction and configured to positively interlock the body and the sleeve rotationally by the locking means positively engaging the recesses in both the body and the sleeve. A method for fixing axially and rotationally a sleeve to a body, wherein the body extends in an axial direction, comprising the steps of: sliding in the axial direction the sleeve onto the body, positively interlocking the body and the sleeve in the axial direction by rotating the sleeve relative to the body, and positively interlocking the body and the sleeve rotationally by sliding in the axial direction locking means into the body and the sleeve, the locking means comprising extensions positively engaging recesses in both the body and the sleeve. Use of the apparatus or method as above for attaching external tool elements or tool components for operations done in connection with open holes, risers, marine risers, wellbores, casings, or liners.

16 Claims, 1 Drawing Sheet

(58) Field of Classification Search
USPC ..... 166/241.6, 242.1, 170, 173, 240; 175/325.5, 406; 403/348, 353, 290, 329
See application file for complete search history.

(56) References Cited

U.S. PATENT DOCUMENTS

| | | | | |
|---|---|---|---|---|
| 2,051,525 | A * | 8/1936 | Howard | B28D 1/146 279/100 |
| 4,549,613 | A | 10/1985 | Case | |
| 4,905,576 | A * | 3/1990 | Reynolds | B60T 11/16 403/315 |
| 6,283,511 | B1 * | 9/2001 | Kamp | E21B 17/0426 285/334.4 |
| 7,213,655 | B2 * | 5/2007 | Parrott | E21B 43/11 166/240 |
| 7,219,753 | B2 * | 5/2007 | Gaul | B23B 31/11 175/403 |
| 7,490,677 | B2 | 2/2009 | Buytaert et al. | |
| 7,861,776 | B2 * | 1/2011 | McKee | E21B 17/046 166/237 |
| 2004/0084191 | A1 | 5/2004 | Laird | |
| 2011/0227336 | A1 | 9/2011 | Møgedal et al. | |
| 2011/0265988 | A1 | 11/2011 | Hern et al. | |
| 2014/0262216 | A1 * | 9/2014 | Perry | E21B 17/1057 166/241.6 |

* cited by examiner

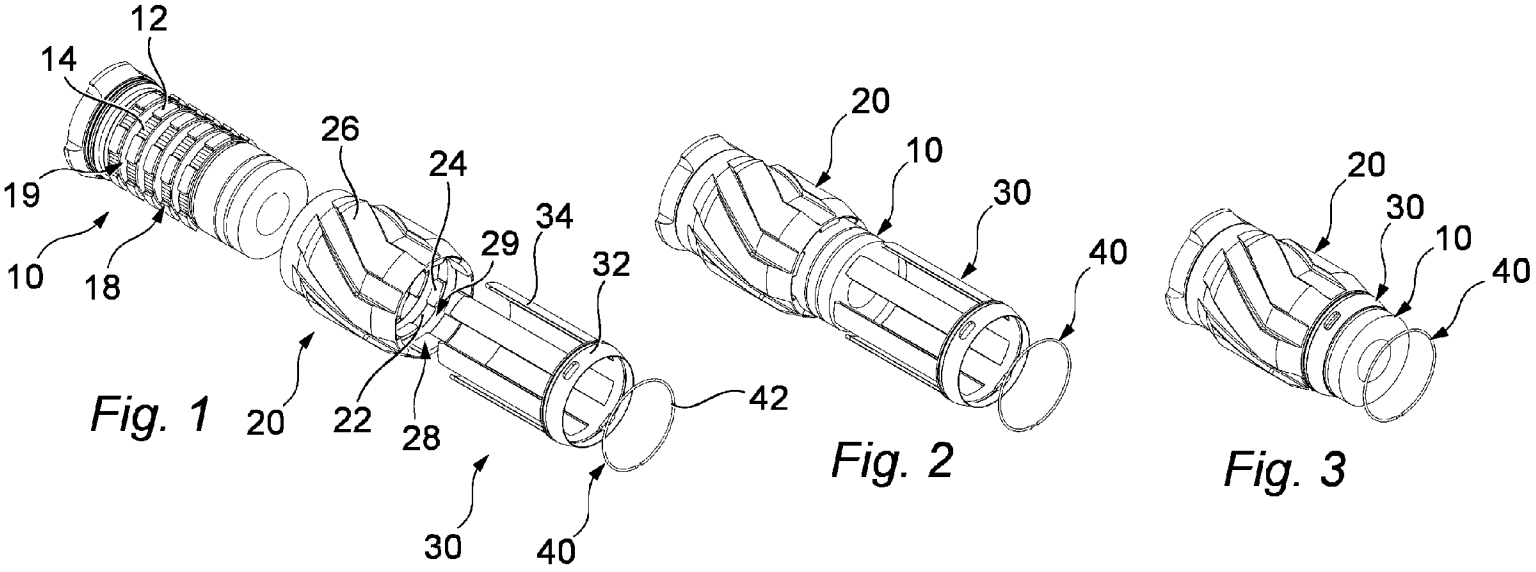
Fig. 1
Fig. 2
Fig. 3
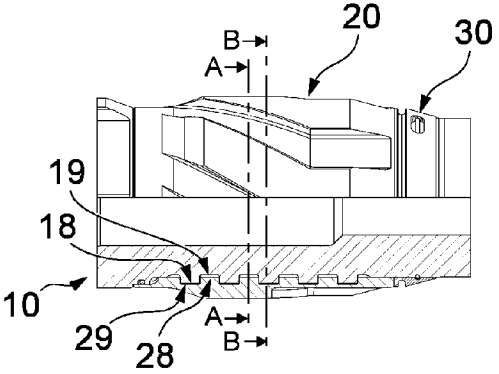
Fig. 5
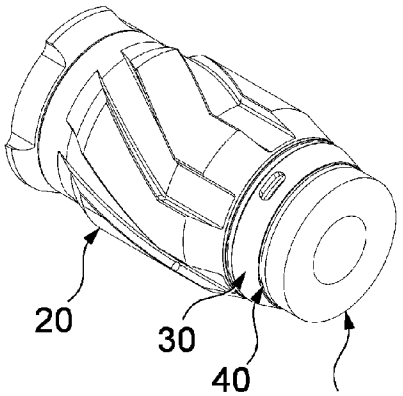
Fig. 4
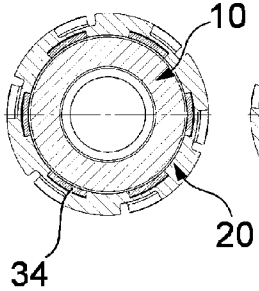
Fig. 6
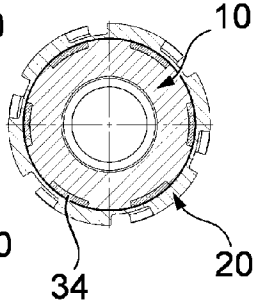
Fig. 7

TOOL ASSEMBLY APPARATUS AND METHOD

TECHNICAL FIELD

The present disclosure relates to an apparatus and method for securely fixing external components to a tool, e.g. a sleeve about a tool body. More particularly, the present disclosure relates to an apparatus and method for use in oil and gas exploration and production, in particular, but not exclusively, to a wellbore tool having tool elements such as stabilisers, centralisers, or sleeves mounted on a mandrel or sub body. The tool assembly method may be used for auxiliary components used with or upon a string-mounted tool such as a burr mill for performing milling and/or burr removal within a well and the external component in that instance may be a mill sleeve.

BACKGROUND

When an oil or gas well is drilled it is common to insert a liner or casing into the well in order to support the walls as the depth of the well is increased. In order to access oil or gas containing formation outside the casing, the casing is commonly perforated by means of explosives. As the casing is made of a hardwearing material such as steel, when perforation takes place the steel casing is deliberately damaged to provide access from the wellbore through to the formation and as a result, sections of the casing will be left with exposed metal shards or burrs directed into the wellbore.

Insertion of any other tools into the wellbore with such exposed shards or burrs, means the tools are susceptible to damage due to collisions with or scraping against the burrs formed during perforation. In particular, delicate screens used for the filtering of fluids downhole can easily be ruptured on contact with the burrs. It would therefore be advantageous to find a method of removing these burrs to avoid damaging tools downhole. One way to remove burrs may be to use a burr mill attached to a drill string and by rotation of the drill string through the wellbore, burrs may be removed.

It is a desire to make any connection between the main body of the tool and any external components such as a stabiliser, centraliser, mill sleeve etc. as strong as possible, because very large forces act on the burr mill in use leading to possible detrimental effects on the stability of auxiliary externally mounted components. There may be junk and debris that creates very high forces on the tool during normal usage. The environment for the connector also puts restrictions upon the fixation of such an external component. Furthermore, space for the connector is limited.

An ordinary screw and bolt connector may not be able to withstand the axial or rotational forces acting on the tool. In addition, vibrations may assist in backing out bolts and unscrewing screws and threaded connectors, thereby loosening the tool components. The environment for these kinds of tools is not an environment suitable for screw connectors.

A further problem is that screws and bolts may some times be forgotten completely to be attached. If remembered, they may be incompletely or incorrectly assembled.

It is thus desired to have a system for fixing a sleeve that is not only as strong as possible but also as safe as possible and as easy to use as possible. Additionally, it is desirable to avoid cumbersome arrangements from a technical and/or economical point of view. The present invention is directed to overcoming one or more of the problems as set forth above.

SUMMARY OF THE INVENTION

It is an object of the present invention to provide an apparatus and method for fixing external components to a tool. This object can be achieved by the features as defined in the independent claims. Further enhancements are characterized by the dependent claims.

According to one embodiment an apparatus comprises a body extending in an axial direction, a sleeve for the body, and locking means for locking the body and the sleeve. The body and the sleeve comprise complementary mating protrusions and recesses (merlons and crenels) configured to positively interlock the body and the sleeve in the axial direction and configured to positively interlock the body and the sleeve rotationally by the locking means positively engaging the recesses in both the body and the sleeve.

According to one embodiment a method for fixing axially and rotationally a sleeve to a body, wherein the body extends in an axial direction, comprises the steps of sliding in the axial direction the sleeve onto the body, positively interlocking the body and the sleeve in the axial direction by rotating the sleeve relative to the body, and positively interlocking the body and the sleeve rotationally by sliding in the axial direction locking means into the body and the sleeve, the locking means comprising extensions positively engaging recesses in both the body and the sleeve.

According to one embodiment the above apparatus or method may be used for attaching tool elements or components for operations done in connection with open holes, risers, marine risers, wellbores, casings, or liners. According to one embodiment, a downhole tool may comprise the above apparatus.

Many external components for downhole tools are fashioned upon sleeves or sleeve like components, each such sleeve having as appropriate an external working surface adapted to a purpose such as resisting wear, spacing the tool from an adjacent formation or wellbore surface, defining flow channels etc. Thus description of the invention herein in the realisation of a sleeve is for convenience and is to be understood as extending to all such external components or elements to be assembled upon a core body or mandrel in a sliding fit, typically including an axial displacement towards the intended assembly form. In a method of assembly to be more particularly described herein below, component parts are presented to each other, aligned and located together by a combination of axial and rotational movements, and secured by presenting a locking component axially over the located parts which locking component resists separation of the located parts by mutually engaging corresponding protrusions and recesses.

At least one embodiment fixes a sleeve to a body with an apparatus that is as strong as possible, but also very safe so that incorrect fixation can be avoided. At least one embodiment provides a mill sleeve suitable for use in a downhole tool assembly dressed with milling elements (not illustrated) for the removal of burrs or other unwanted debris from inside a wellbore.

At least one of the above embodiments provides one or more solutions to the problems and disadvantages with the background art. Other technical advantages of the present disclosure will be readily apparent to one skilled in the art from the following description and claims. Various embodiments of the present application attain only a subset of the advantages set forth. No one advantage is critical to the embodiments. Any claimed embodiment may be technically combined with any other claimed embodiment(s).

BRIEF DESCRIPTION OF THE DRAWINGS

The accompanying drawings illustrate presently preferred exemplary embodiments of the disclosure, and together with the general description given above and the detailed description of the preferred embodiments given below, serve to explain, by way of example, the principles of the disclosure.

FIG. 1 is a diagrammatic illustration of an apparatus according to an exemplary embodiment of the present disclosure;

FIG. 2 is a diagrammatic illustration of an apparatus according to an exemplary embodiment of the present disclosure where two parts are assembled;

FIG. 3 is a diagrammatic illustration of an apparatus according to an exemplary embodiment of the present disclosure where three parts are assembled;

FIG. 4 is a diagrammatic illustration of an apparatus according to an exemplary embodiment of the present disclosure where four parts are assembled;

FIG. 5 is a diagrammatic illustration of an apparatus according to an exemplary embodiment of the present disclosure;

FIG. 6 is a diagrammatic illustration of a section A-A of an apparatus according to an exemplary embodiment of the present disclosure; and FIG. 7 is a diagrammatic illustration of a section B-B of an apparatus according to an exemplary embodiment of the present disclosure.

DETAILED DESCRIPTION

When referring to "positively interlocking" between two or more parts, then it is to be understood that the parts are locked to each other by way of their form and shape. The German language has a specific technical term for this, namely "formschlüssige Verbindung".

FIG. 1 is a diagrammatic illustration of an apparatus according to an exemplary embodiment of the present disclosure. A body (10) may be a tool body, a mandrel, a drill string, part of a drill string, a drill pipe, or similar. The body may be used for attaching external tool elements or tool components for operations done in connection with open holes, risers, marine risers, wellbores, casings, or liners. For example, a downhole tool may comprise the body (10). The body (10) extends in an axial direction. This axial direction is normally the direction in which the well extends. The body (10) may be cylindrical in shape, or substantially cylindrical in shape.

A sleeve (20) may be or comprise one of a tool element or component, or tool working surface or contact face (26). The tool component (26) may comprise stabiliser contoured surfaces (26). The contoured surfaces (26) may be arranged on the circumferential surface of the sleeve. The sleeve (20) may extend in the axial direction and the sleeve (20) may be cylindrical, or substantially cylindrical, in shape. The sleeve (20) is adapted to fit onto the body (10). For example, the sleeve (20) could be slid onto the body (10) to form a tool assembly.

The apparatus may further comprise a locking means (30) for locking the body (10) and the sleeve (20) together. When the sleeve (20) is correctly arranged on the body (10), then the locking means (30) may be inserted and lock the sleeve (20) onto the body (10). This will be explained in more detail below.

A locking device (40) may be used to lock the locking means (30) together with the sleeve (20) and the body (10). The locking device (40) may be a locking wire (42), or any other suitable locking device.

With reference to FIG. 1 an exemplary embodiment of the positive interlocking between the body (10) and the sleeve (20), and the means therefore, is now described. The body (10) and the sleeve (20) may comprise complementary mating protrusions (12, 24) and recesses (14, 22) configured to positively interlock the body (10) and the sleeve (20) in the axial direction. The protrusions (12, 24) and recesses (14, 22) may be configured to positively interlock the body (10) and the sleeve (20) rotationally by the locking means (30) positively engaging the recesses (14, 22) in both the body (10) and the sleeve (20).

The protrusions (12) arranged on the body (10) may be merlons (12) and the protrusions (24) arranged on the inside of the sleeve (20) may be merlons (12). The recesses (14) arranged on the body (10) may be crenels (14) and the recesses (22) arranged on the inside of the sleeve (20) may be crenels (22). According to one embodiment, the radial extension of the protrusions (12) of the body (10) correspond with the radial recession of the recesses (22) of the sleeve (20), and the radial extension of the protrusions (24) of the sleeve (20) correspond with the radial recession of the recesses (14) of the body (10).

When the protrusions (24) of the sleeve (20) are lined up with the recesses (14) of the body (10), then the sleeve (20) may be slid onto the body (10). When the sleeve (20) is fully slid onto the body (10), then the sleeve (20) and the body (10) may be rotated relative to each other so that the protrusions (12) of the body (10) are lined up with the protrusions (24) of the sleeve (20). Hereby the body (10) and the sleeve (20) are interlocked with each other in the axial direction. This is illustrated in FIG. 2.

According to at least one embodiment, to allow the relative rotation between the sleeve (20) and the body (10), the protrusions (12) and recesses (14) of the body (10) may be arranged on a circumferential area (18) around a part of its outer surface. Similar, the protrusions (24) and recesses (22) of the sleeve (20) may be arranged on a circumferential area (28) around a part of its inner surface. The body (10) may comprises a circumferential area (19) without protrusions and recesses arranged around a part of its outer surface to allow space for the corresponding protrusions (24) and recesses (22) of the sleeve (20) to positively interlock. The sleeve (20) comprises a circumferential area (29) without protrusions and recesses arranged around a part of its inner surface to allow space for the corresponding protrusions (12) and recesses (14) of the body (10) to positively interlock. Hereby the body (10) and the sleeve (20) can rotate relatively only when fully and correctly assembled. For example, longer protrusions (24) in the axial direction on the first circumferential area (28) of the sleeve (20) prevent a rotation. A relative rotation is first possible when the first circumferential area (28) of the sleeve (20) is fully and correctly aligned with the last circumferential area (19) without any protrusions or recesses.

It is thus when the circumferential area (19) without protrusions and recesses of the body (10) is lined up with the circumferential area (28) with the protrusions (24) and recesses (22) of the sleeve (20) that the body (10) and sleeve (20) may be rotated relatively. This assures that the apparatus is always correctly assembled. This also assures a very strong interlocking in the axial direction. This axial interlocking withstands vibrations and is not subject to the environment of the apparatus because the internal arrangement of the protrusions and recesses. Thus the fastening is thereby internalised and not subject to external interferences.

The body (10) and the sleeve (20) may comprise a plurality of circumferential areas (18, 28) of protrusions and recesses axially arranged and a plurality of circumferential areas (19, 29) without protrusions and recesses axially arranged along the body (10) and the sleeve (20), respectively.

FIG. 2 is a diagrammatic illustration of an apparatus according to an exemplary embodiment of the present disclosure where the body (10) and the sleeve (20) have been fully assembled. When the body (10) and the sleeve (20) are rotated relatively, then the recesses (14) of the body (10) and the recesses (22) of the sleeve (20) may be aligned with each other. This in turn allows the locking means (30) to be fitted.

The locking means (30) may comprise extensions (34) protruding in the axial direction. These extensions (34) may be like fingers inserted into the body (10) and sleeve (20). The extensions (34) may be configured to positively engage the recesses (14, 22) of the body (10) and the sleeve (20) to positively interlock the body (10) and the sleeve (20). The locking means (30) may comprise a ring (32) on which the extensions (34) are arranged.

According to one embodiment, each circumferential area (18, 28) of protrusions and recesses comprises six protrusions and six recesses. Accordingly, the locking means (30) comprises six extensions (34).

FIG. 3 is a diagrammatic illustration of an apparatus according to an exemplary embodiment of the present disclosure where the body (10), the sleeve (20), and the locking means (30) are assembled. The locking device (40) may then be attached. The locking device (40) can only be attached to the body (10), when the sleeve (20) and the locking means (30) are fully and correctly assembled.

FIG. 4 is a diagrammatic illustration of an apparatus according to an exemplary embodiment of the present disclosure where the body (10), the sleeve (20), the locking means (30), and the locking device (40) are assembled. The apparatus may comprise a tool element (26). According to one embodiment, the sleeve (20) comprises surface contoured stabilising elements (26). According to one embodiment, the body (10) is a downhole tool body (10).

FIG. 5 is a diagrammatic illustration of an apparatus according to an exemplary embodiment of the present disclosure. FIG. 6 is a diagrammatic illustration of a section A-A of FIG. 5; and FIG. 7 is a diagrammatic illustration of a section B-B of FIG. 5. In FIGS. 5-7 sections of the assembled apparatus are illustrated. In these Figs. the body (10), the sleeve (20), the locking means (30), and the locking device (40) are assembled.

FIG. 5 illustrates how the circumferential area (19) without protrusions and recesses of the body (10) is lined up with the circumferential area (28) with the protrusions (24) and recesses (22) of the sleeve (20) when the sleeve (20) is fully assembled onto the body (10). Additionally, FIG. 5 illustrates how the circumferential area (29) without protrusions and recesses of the sleeve (20) is lined up with the circumferential area (18) with the protrusions (12) and recesses (14) of the body (10).

FIGS. 5-7 illustrate how the extensions (34) of the locking means (30) have been entered into the recesses (14, 22) of the body (10) and the sleeve (20). The extensions (34) prevent any relative rotational movement between the body (10) and the sleeve (20). The extensions (34) are positively interlocking the body (10) and the sleeve (20) by positively engaging the protrusions (12, 24) of the body (10) and the sleeve (20) and filling out the recesses (14, 22) of the body (10) and the sleeve (20).

FIGS. 1-4 illustrate how the apparatus is assembled, except for the relative rotation between the body (10) and the sleeve (20). According to one embodiment, a method for fixing axially and rotationally the sleeve (20) to the body (10), wherein the body extends in an axial direction, may comprise the following steps. Firstly, slide in the axial direction the sleeve (20) onto the body (10). Secondly, positively interlock the body (10) and the sleeve (20) in the axial direction by rotating the sleeve (20) relative to the body (10). Thirdly, positively interlock the body and the sleeve rotationally by sliding in the axial direction the locking means (30) into the body (10) and the sleeve (20). The extensions (34) of the locking means (30) positively engaging the recesses (14, 22) and protrusions (12, 24) in both the body (10) and the sleeve (20).

According to one embodiment, a fourth step may be to attach a locking device (40) when the body (10), the sleeve (20), and the locking means (30) are fully assembled. This locking device may be a locking wire (34) or similar.

According to one embodiment, a very safe and secure method and apparatus for fixing the sleeve (20) onto the body (10) is achieved, because the locking device (40) can only be attached correctly and lock the apparatus if all parts have been correctly and fully assembled.

According to one embodiment, the relative rotation between the body (10) and the sleeve (20) may be half a turn (180 degrees) or less, preferably 60 degrees. The amount of rotation depends on the number of protrusions and recesses arranged circumferential on the body (10) and the sleeve (20).

In one embodiment, markings or indications may be arranged on the apparatus to show a user when the body (10) and the sleeve (20) are in the right position for the locking means (30) to be inserted. In one embodiment, a snap or spring device may be used for indicating when the body (10) and the sleeve (20) are in the right position for the locking means (30) to be inserted.

The apparatus or method as disclosed herein may be used for attaching external tool components for operations done in connection with open holes, risers, marine risers, wellbores, casings, or liners. In one embodiment, a downhole tool may incorporate one or more of the apparatus to fix a tool element or component for the completion of assembly of a downhole tool.

According to one embodiment, a tool sleeve (20) for the apparatus as described above is disclosed. The tool sleeve (20) may be provided as a separate part as it is subject to wear and needs to be replaced more often that the body (10) or the locking means (30). Thus for example a stabiliser or centraliser can be based upon the design of the replaceable sleeve (20). Such a tool component may be used in conjunction with a casing cleanup tool such as a burr mill. A tool sleeve contemplated in this invention may be dressed with an abrasive substance on one or more surfaces to augment the milling operation by removing a proportion of burrs during reciprocation of the string in the well with rotation if required.

At least one of the embodiments achieves a fixation of the sleeve (20) that can withstand very large axial and rotational forces. It does not rely on any screw threads or bolts.

At least one of the embodiments achieves a safe and secure fixation of the sleeve (20). All parts of the apparatus must be correctly assembled because they only fit together in one way. In other words, if incorrectly assembled, then the following part will not fit. This fact provides a visual indication confirming that the sleeve (20) is correctly and safely fixed. This because all parts (body (10), sleeve (20), locking means (30), and locking device (40)) of the apparatus must be correctly assembled, otherwise the parts will be left over.

It will be apparent to those skilled in the art that various modifications and variations can be made to the apparatus and method. Other embodiments will be apparent to those skilled in the art from consideration of the specification and practice of the disclosed apparatus and method. It is intended that the specification and examples be considered as exemplary only, with a true scope being indicated by the following claims and their equivalents.

LIST OF ELEMENTS MENTIONED ABOVE AND IDENTIFIABLE BY CALL OUTS IN THE ACCOMPANYING DRAWINGS

10 body
12 protrusion
14 recess
18 circumferential area with protrusion and recesses
19 circumferential area with no protrusion or recesses
20 sleeve
22 recess
24 protrusion
26 surface of tool element
28 circumferential area with protrusion and recesses
29 circumferential area with no protrusion or recesses
30 locking means
32 ring
34 extensions
40 locking device
42 locking wire

What is claimed is:

1. An apparatus, comprising:

a body extending in an axial direction;

a sleeve for the body extending in an axial direction; and locking means comprising a ring for locking the body and the sleeve, wherein the body and the sleeve comprise complementary mating protrusions and recesses configured to positively interlock the body and the sleeve in the axial direction and configured to positively interlock the body and the sleeve rotationally by the locking means positively engaging the recesses in both the body and the sleeve, and further wherein the body and the sleeve comprise a plurality of first circumferential areas having the protrusions and recesses axially arranged along the body and the sleeve and a plurality of second circumferential areas without protrusions and recesses axially arranged along the body and the sleeve, and the first circumferential areas having the protrusions and recesses alternate with the second circumferential areas without protrusions and recesses in the axial directions of the body and the sleeve.

2. The apparatus according to claim 1, wherein the plurality of first circumferential areas of the body is provided on a first part of an outer surface of the body, the plurality of first circumferential areas of the sleeve is provide on a first part of an inner surface of the sleeve, the plurality of second circumferential areas without protrusions and recesses is arranged around a second part of the outer surface of the body and provides space for the corresponding protrusions and recesses of the sleeve to positively interlock, and the plurality of second circumferential areas without protrusions and recesses is arranged around a second part of the inner surface of the sleeve and provides space for the corresponding protrusions and recesses of the body to positively interlock.

3. The apparatus according to claim 2, wherein each first circumferential area having protrusions and recesses comprises six protrusions and six recesses.

4. The apparatus according to claim 1, wherein a radial extension of the protrusions of the body correspond with a radial recession of the recesses of the sleeve, and a radial extension of the protrusions of the sleeve correspond with a radial recession of the recesses of the body.

5. The apparatus according to claim 1, wherein the locking means comprises extensions protruding in an axial direction configured to positively engaging the recesses of the body and the sleeve to positively interlock the body and the sleeve.

6. The apparatus according to claim 5, wherein the locking means comprises six extensions.

7. The apparatus according to claim 1, further comprising a locking device for locking the body, sleeve, and locking means when fully assembled.

8. The apparatus according to claim 1, wherein the sleeve is part of an external tool element or component selected from a centraliser, stabiliser, or mill sleeve.

9. The apparatus according to claim 8, wherein the body is a downhole tool body.

10. The apparatus according to claim 1, wherein the protrusions and recesses extend straight around circumferential areas of the body and the sleeve.

11. A method for fixing axially and rotationally a sleeve to a body, wherein the body extends in an axial direction, comprising:

sliding in the axial direction the sleeve onto the body, wherein the body comprises a plurality of first circumferential areas having protrusions and recesses axially arranged on the body and a plurality of second circumferential areas without protrusions and recesses axially arranged along the body, and the first circumferential areas having protrusions and recesses alternate between the second circumferential areas without protrusions and recesses in the axial direction of the body;

positively interlocking the body and the sleeve in the axial direction by rotating the sleeve relative to the body and positioning corresponding protrusions and recesses of the sleeve in space provided by the plurality of second circumferential areas without protrusions and recesses axially arranged along the body; and positively interlocking the body and the sleeve rotationally by sliding in the axial direction locking means into the body and the sleeve, the locking means comprising extensions positively engaging the recesses in both the body and the sleeve, wherein the recesses in the sleeve are provided on an inner surface of the sleeve that faces an outer surface of the body.

12. The method of claim 11, further comprising the step of attaching a locking device when the body, sleeve, and locking means are fully assembled.

13. The method of claim 11, wherein the rotation is 180 degrees or less.

14. The method according to claim 11, wherein at least a portion of the body extends through the length of the sleeve and projects outwardly from the sleeve.

15. The method according to claim 11, wherein the positively interlocking the body and the sleeve in the axial direction comprises aligning first circumferential areas of the sleeve having protrusions and recesses with the second circumferential areas of the body without protrusions and recesses.

16. The method according to claim 11, wherein the positively interlocking the body and the sleeve in the axial direction comprises aligning the recesses of the body and the recesses of the sleeve.

* * * * *